US005536435A

United States Patent [19]

Chapman et al.

[11] Patent Number: 5,536,435

[45] Date of Patent: Jul. 16, 1996

[54] PROCESS FOR MAKING PEROXYACID CONTAINING PARTICLES

[75] Inventors: Benjamin E. Chapman; Steven M. Gabriel; Jeffrey E. Boucher, all of Cincinnati; Daniel L. Strauss, Mason, all of Ohio

[73] Assignee: The Procter & Gamble Company, Cincinnati, Ohio

[21] Appl. No.: 157,494

[22] Filed: Nov. 23, 1993

Related U.S. Application Data

[63] Continuation of Ser. No. 957,578, Oct. 7, 1992, abandoned.

[51] Int. Cl.[6] ..... C11D 1/22; C11D 3/395; C11D 11/00; C11D 17/06

[52] U.S. Cl. ..... 510/310; 252/186.26; 252/186.42; 264/176.1; 264/177.11; 264/177.19; 264/211.12; 510/349; 510/375; 510/306; 510/444; 510/451

[58] Field of Search ..... 252/91, 95, 99, 252/104, 174, 174.13, 186.26, 186.42; 364/176.1, 177.11, 177.19, 211.12

[56] References Cited

U.S. PATENT DOCUMENTS

| | | | |
|---|---|---|---|
| 2,220,099 | 11/1940 | Guenther et al. | 260/505 |
| 2,477,383 | 7/1949 | Lewis | 252/161 |
| 3,494,787 | 2/1970 | Lund et al. | 117/100 |
| 3,664,961 | 5/1972 | Norris | 252/99 |
| 3,936,537 | 2/1976 | Baskerville et al. | 427/242 |
| 3,950,275 | 4/1976 | Toyoda et al. | 252/527 |
| 3,989,635 | 11/1976 | Toyoda et al. | 252/135 |
| 3,996,152 | 12/1976 | Edwards et al. | 252/186 |
| 4,091,544 | 5/1978 | Hutchins | 34/9 |
| 4,100,095 | 7/1978 | Hutchins | 252/99 |
| 4,105,827 | 8/1978 | Brichard et al. | 428/403 |
| 4,126,573 | 11/1978 | Johnston | 252/99 |
| 4,287,135 | 9/1981 | Stober et al. | 260/502 |
| 4,487,710 | 12/1984 | Kaminsky | 252/546 |
| 4,497,757 | 2/1985 | Beimesch et al. | 264/13 |
| 4,634,551 | 1/1987 | Burns et al. | 252/102 |
| 4,642,198 | 2/1987 | Humphreys et al. | 252/94 |
| 4,686,063 | 8/1987 | Burns | 252/102 |
| 4,715,979 | 12/1987 | Moore et al. | 252/91 |
| 4,758,369 | 7/1988 | Dryoff et al. | 252/94 |
| 4,781,854 | 11/1988 | Overton et al. | 252/100 |
| 4,810,413 | 3/1989 | Pancheri et al. | 252/174.12 |
| 4,818,425 | 4/1989 | Meijer et al. | 252/94 |
| 4,824,591 | 4/1989 | Dryoff et al. | 252/94 |
| 4,824,592 | 4/1989 | Rerek et al. | 252/95 |
| 4,828,747 | 5/1989 | Rerek et al. | 252/95 |
| 4,852,989 | 8/1989 | Burns et al. | 8/107 |
| 4,853,143 | 8/1989 | Hardy | 252/102 |
| 4,909,953 | 3/1990 | Sadlowski et al. | 252/99 |
| 4,927,557 | 5/1990 | Revis | 252/174.15 |
| 4,929,377 | 5/1990 | Emmons et al. | 251/100 |
| 4,997,590 | 3/1991 | Bowling | 252/186.31 |
| 5,000,978 | 3/1991 | Davidson | 427/27 |
| 5,004,558 | 4/1991 | Dryoff et al. | 252/95 |
| 5,045,238 | 9/1991 | Jolicoeur | 252/550 |
| 5,049,298 | 9/1991 | Ploumen et al. | 252/95 |
| 5,055,218 | 10/1991 | Getty et al. | 252/94 |
| 5,066,425 | 11/1991 | Ofosu-Asante | 252/546 |
| 5,091,106 | 2/1992 | Jacobs et al. | 252/186.26 |
| 5,152,932 | 10/1992 | Mueller | 252/550 |
| 5,178,798 | 1/1993 | Jolicoeur | 252/553 |
| 5,180,515 | 1/1993 | Boucher | 252/135 |

FOREIGN PATENT DOCUMENTS

| | | | |
|---|---|---|---|
| 0167375 | 1/1986 | European Pat. Off. . | |
| 0176124 | 4/1986 | European Pat. Off. . | |
| 0201958 | 11/1986 | European Pat. Off. . | |
| 0299671 | 1/1987 | European Pat. Off. . | |
| 0240481 | 10/1987 | European Pat. Off. . | |
| 0254331 | 1/1988 | European Pat. Off. . | |
| 0256443 | 2/1988 | European Pat. Off. . | |
| 0340847 | 11/1989 | European Pat. Off. . | |
| 0347988 | 12/1989 | European Pat. Off. . | |
| 504952A1 | 9/1992 | European Pat. Off. | C11D 3/39 |
| 1476682 | 6/1977 | United Kingdom . | |

OTHER PUBLICATIONS

*Cake Formation in Particulate Systems,* Griffith, Edward J., Weinheim: VCH Publishing, p. 78 (1991).

*Primary Examiner*—Dennis Albrecht
*Attorney, Agent, or Firm*—M. P. McMahon; M. D. Jones; K. W. Zerby

[57] ABSTRACT

A process for preparing particulate bodies containing a substantially water-insoluble organic peroxyacid compound, which process does not include a solidification step, including an early step of intimately mixing substantially water-insoluble peroxyacid compound with a peroxyacid-stable, water-soluble surfactant.

15 Claims, No Drawings

PROCESS FOR MAKING PEROXYACID CONTAINING PARTICLES

This is a continuation of application Ser. No. 07/957,578, filed on Oct. 7, 1992 now abandoned.

TECHNICAL FIELD

This invention relates to a process for preparing particulate bodies containing a substantially water-insoluble organic peroxyacid compound.

BACKGROUND OF THE INVENTION

Substantially water-insoluble organic peroxyacids such as 6-(nonylamino)-6-oxocaproic acid (NAPAA) can be difficult to use in granular laundry detergent compositions because they tend not to solubilize/disperse satisfactorily in the wash water. The unsolubilized bleach particles on washed fabrics are not aesthetically pleasing and, more importantly, they contribute little to bleaching. Also, dry processes for making peroxyacid-containing particles for inclusion in granular laundry detergents are frequently inefficient because they require high amounts of process recycle (dry finished product which must be brought back into the process), which necessitates high energy input and large equipment requirements. For example, to make 100 pounds of dry peroxyacid-containing particles, one may have to manufacture perhaps 1000 pounds of particles and recycle 900 pounds back into the process.

European Patent Application 0 340 847, Finch et al, published Nov. 8, 1989, discloses a process for preparing dry particulate bodies containing a solid peroxyacid.

U.S. Pat. No. 4,091,544, Hutchins, issued May 30, 1978, discloses a process for drying a water-wet mixture of materials, at least one of which is hydratable.

European Patent Application 0 254 331, Meijer et al, published Jan. 27, 1988 discloses a process for the preparation of agglomerates containing 1,12-diperoxydodecanedioic acid (DPDA) and a water-impermeable material.

SUMMARY OF THE INVENTION

The present invention relates to a process for preparing particulate bodies containing a substantially water-insoluble organic peroxyacid compound, which process does not include a solidification step, including an early step of intimately mixing substantially water-insoluble peroxyacid compound with a peroxyacid-stable, water-soluble surfactant.

It also relates to a process for preparing particulate bodies containing a substantially water-insoluble organic peroxyacid compound, comprising the steps of (a) intimately mixing substantially water-insoluble organic peroxyacid compound with a peroxyacid-stable, water-soluble detergent surfactant; (b) mixing the product of (a) with a crystalline, peroxyacid-compatible material; and (c) forming the product of (b) into particles.

DESCRIPTION OF THE INVENTION

The present invention concerns a process, preferably continuous, for preparing particulate bodies containing a substantially water-insoluble organic peroxyacid compound, which process does not include a solidification step, including an early (preferably first) step of intimately mixing substantially water-insoluble peroxyacid compound (preferably in a composition comprising less than about 50 wt %, most preferably less than about 35 wt %, of water) with a peroxyacid-stable, water-soluble surfactant. This process preferably does not include a solidification step, as takes place in prilling. By solidification is meant that a liquid is transformed to a solid, discrete, particle by means of hydration (as in prilling), via a melt operation, or other. A liquid is defined herein as a substance taking the shape of the container holding it. This early step has been found to improve solubility/dispersability of the peroxyacid-containing particulate bodies in wash water.

The present invention also concerns a process for preparing particulate bodies containing a substantially water-insoluble organic peroxyacid compound, comprising the steps of (a) intimately mixing substantially water-insoluble organic peroxyacid compound with a peroxyacid-stable, water-soluble detergent surfactant; (b) mixing the product of (a) with a crystalline, peroxyacid-compatible material; and (c) forming the product of (b) into particles. This process preferably does not include a solidification step.

Step (b) preferably includes mixing the product of step (a) with a crystalline, peroxyacid-compatible, hydratable material at a temperature which is between freezing and the temperature of hydration of the hydratable material, until the product of (b) comprises from about 3 to about 15 wt. %, preferably from about 8 to about 10 wt. %, more preferably from about 8.5 to about 9.2 wt. %, of non-hydrated water. A preferred completion step, or step (d), is drying until the product of (c) comprises less than about 5 wt. %, preferably less than about 2 wt. %, most preferably less than about 0.5 wt. %, of water.

There can be additional steps inserted between the steps of this invention, e.g. additional mixing and/or extruding. Preferably the present process does not include a cooling step. By "non-hydrated water, sometimes called "free water", is meant water not bound with the crystalline, peroxyacid-compatible, hydrated material. In step (b) immediately above, the percentage of the total water which becomes hydrated is greater than about 2 wt. %, preferably from about 5 to about 50 wt. %, most preferably from about 15 to about 25 wt. %.

The peroxyacid compound of step (a), or the early step, is preferably in a wet cake comprising from about 20 to about 80 wt. %, preferably about 50 to about 70 wt. %, most preferably about 60 wt. % of peroxyacid, preferably NAPAA, and from about 5 to about 70 wt. %, preferably from about 10 to about 40 wt. %, most preferably from about 20 to about 30 wt. %, of water. Preferably, the peroxyacid slurry has been filtered to form the wet cake with the above levels.

This low moisture wet cake allows for reduced levels of process recycle, hence a more efficient process with less energy input necessary and smaller equipment requirements.

Preferably, the intimate mixture step (a) takes place in a high shear mixer, an extruder, or an extruder/mixer, most preferably in an extruder/mixer.

Preferably, the step in which the peroxyacid and crystalline, peroxyacid-compatible material are mixed, step (b), takes place in a low or a high speed mixer. Examples include: V-blender with intensifier bar, Lodige CB and/or Lodige KM mixers. Most preferred is a Lodige KM Mixer.

Preferably, the particle formation step (c), is accomplished by mixing in a Turbolizer, a Lodige KM mixer, or more preferably in an extruder, most preferably in a Fuji Paudal, axial or radial extruder. Particle forming in the Lodige KM can be accomplished by extended mixing in the same unit utilized for step (b), i.e. until the mixture has from about 8 to about 14 wt. % of non-hydrated water and acceptable particle size is obtained.

Preferably, step (b) takes place in a low speed mixer, like a Lodige KM, and step (c) takes place in an extruder, preferably an axial extruder, most preferably a Fuji TDG axial extruder. Without meaning to be bound by theory, it is believed that this extrusion step provides particles with a desirable uniform particle size. Further, because of the intimate surfactant mixing step, these particles have a good rate of solubility in the wash water.

Alternately, step (b) takes place in a high speed mixer, such as a Lodige CB, and step (c) takes place in a low speed mixer/agglomerator, most preferably a Lodige KM.

A third ingredient for inclusion in step (b) mixing is process recycle (dried finished product return), which serves to reduce the final mixture moisture content. Process recycle ratio is defined as the rate of dry finished product returned to the rate of total dry product leaving the dryer. Preferred is a recycle ratio of less than about 0.8, more preferably less than about 0.4.

Organic Peroxyacid

The processes of the present invention contain from about 10 to about 90, preferably from about 20 to about 80, most preferably from 50 to 60, weight % of substantially water-insoluble organic peroxyacids. The preferred ratio of peroxyacid to surfactant in the intimate mixing step (a) is between about 400:1 and about 4:1, preferably between about 80:1 and about 5:1, most preferably between between about 10:1 and 7:1.

The following organic peroxyacids are preferred: 4-nonylamino-4-oxoperoxybutyric acid; 6-(nonylamino)-6-oxocaproic acid; 1,12-diperoxydodecanedioic acid,; heptyl sulfonylperpropionic acid; decylsulphonyl perpropionic acid; and heptyl-, octyl-, nonyl-, and decyl-sulphonylperbutyric acid; and mixtures thereof.

Of the organic peroxyacids, amidoperoxyacids (amide substituted peroxycarboxylic acids) are preferred. Suitable amidoperoxyacids for use herein are described in U.S. Pat. Nos. 4,634,551 and 4,686,063, both Burns et al, issued Jan. 6, 1987 and Aug. 11, 1987, respectively, both incorporated herein by reference. Suitable amidoperoxyacids are of the formula:

$$R^1-NH-\underset{\underset{O}{\|}}{C}-R^2-\underset{\underset{O}{\|}}{C}-OOH \text{ or } R^1-\underset{\underset{O}{\|}}{C}-NH-R^2-\underset{\underset{O}{\|}}{C}-OOH$$

wherein $R^1$ is an alkyl group containing from about 6 to about 12 carbon atoms, and $R^2$ is an alkylene containing from 1 to about 6 carbon atoms. Preferably, $R^1$ is an alkyl group containing from about 8 to about 10 carbon atoms, and $R^2$ is an alkylene group containing from about 2 to about 4.

Also suitable for use herein are peroxyfumarates, which are described in U.S. Pat. No. 4,852,989, Burns et al, issued Aug. 1, 1989, incorporated herein by reference, and sulfone peroxyacids (sulfone peroxycarboxylic acids), which are described in U.S. Pat. Nos. 4,758,369, 4,824,591, and 5,004,558, all Dryoff et al, issued Jul. 19, 1988, Apr. 25, 1989, and Apr. 2, 1991, respectively, all incorporated herein by reference.

Example I of U.S. Pat. No. 4,686,063 contains one description of the synthesis of NAPSA, from column 8, line 40 to Column 9, line 5, and NAPAA, from column 9, line 15 to column 9, line 65. At the end of the amidoperoxyacid synthesis, the reaction is quenched with water, filtered, washed with water to remove some excess sulfuric acid (or other strong acid with which the peroxyacid was made), and filtered again.

The amidoperoxyacid wet cake thus obtained can be contacted with a phosphate buffer solution at a pH between about 3.5 and 6, preferably between about 4 and 5, according to U.S. Pat. No. 4,909,953, Sadlowski et al, issued Mar. 20, 1990, which is incorporated herein by reference.

Other agents for storage stabilization or exotherm control can be added to the amidoperoxyacid before incorporation into the final product. For example, boric acid, an exotherm control agent disclosed in U.S. Pat. No. 4,686,063, Burns, issued Aug. 11, 1987 and incorporated herein, can be mixed with the amidoperoxyacid (which has been washed in phosphate buffer) in about a 2:1 peracid:boric acid ratio. The phosphate buffer washed amidoperoxyacid can also be mixed with appropriate amounts of dipicolinic acid and tetrasodium pyrophosphate, a chelating stabilization system. Chelants can optionally be included in the phosphate buffer before contact with the wet cake.

The wet cake in step (a) is preferably made up of particles with an average particle diameter of from about 0.1 to about 260 microns, preferably from about 10 to about 100 microns, and most preferably from about 30 to about 60 microns. Small particle size NAPAA crystals are desired herein. See U.S. Pat. No. 5,055,218, Getty et al, issued Oct. 8, 1991, which is incorporated herein by reference.

NAPAA filter cake herein is preferably washed twice in phosphate buffer. It has been found that two successive phosphate buffer washes lend optimal stability to NAPAA.

Particulate (solid), organic peroxyacids with a theoretical AvO (available oxygen) of between about 3 and about 12, most preferably between 5 and 7, are preferred.

Most preferred for use herein is NAPAA. Another name for the nonylamide of peroxyadipic acid ("NAPAA") is 6-(nonylamino)- 6-oxo-caproic acid. The chemical formula for NAPAA is:

$$CH_3(CH_2)_8\overset{\overset{HO}{|}}{N}\overset{\overset{O}{\|}}{C}(CH_2)_4COOH$$

The molecular weight of NAPAA is 287.4.

Detergent compositions and bleaching compositions containing NAPAA provide extremely effective and efficient surface bleaching of textiles. Stains and/or soils are removed from the textiles. These compositions are particularly effective at removing dingy soils from textiles.

NAPAA's polar amide or substituted amide moiety results in a peroxyacid which has a very low vapor pressure and thus possesses a low odor profile as well as excellent bleaching performance. It is believed that the polarity of the amide group results in a reduction of vapor pressure of the peroxyacid, and an increase in melting point.

NAPAA can be used directly as a bleaching agent. It has a reduced vapor pressure and a good odor profile in laundry applications.

NAPAA can be prepared by, for example, first reacting NAAA (mononnyl amide of adipic acid), sulfuric acid, and hydrogen peroxide. The reaction product is quenched by addition to ice water followed by filtration, washing with distilled water, and final suction filtration to recover the wet cake. Washing can be continued until the pH of the filtrate is neutral.

These bleach-containing particulate bodies are preferably added to a bleaching composition or detergent composition which is added to the wash water in a laundering application.

It is also preferred that the NAPAA pH (10% solids in water) be between about 4.2 and 4.8. Surprisingly, this pH results in more thermally stable particles.

Peroxyacid-Stable Detergent Surfactant

The particulate bodies of this invention also include from about 1 to 40 weight % of peroxyacid-stable, water-soluble detergent surfactant selected from the group consisting of anionics, nonionics, zwitterionics, ampholytics, and mixtures thereof. From about 2 to 25 weight % of detergent surfactant is preferred and from about 5 to about 15 weight % is most preferred. Anionic surfactant is preferred and salts of $C_{11-13}$ linear alkyl benzene sulfonate, $C_{12-16}$ alkyl sulfate and/or methyl ester sulfonates are more preferred. Sodium $C_{12-13}$ linear alkyl benzene sulfonate is most preferred.

Detergent surfactants useful herein are listed in U.S. Pat. No. 3,664,961, Norris, issued May 23, 1972, and U.S. Pat. No. 3,919,678, Laughlin et al, issued Dec. 30, 1975, both incorporated herein by reference. The following are representative examples of detergent surfactants useful in the present compositions.

Water-soluble salts of the higher fatty acids, i.e., "soaps", are useful anionic surfactants in the compositions herein. This includes alkali metal soaps such as the sodium, potassium, ammonium, and alkylammonium salts of higher fatty acids containing from about 8 to about 24 carbon atoms, and preferably from about 12 to about 18 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap.

Useful anionic surfactants also include the water-soluble salts, preferably the alkali metal, ammonium and alkylolammonium salts, of organic sulfuric reaction products having in their molecular structure an alkyl group containing from about 10 to about 20 carbon atoms and a sulfonic acid or sulfuric acid ester group. (Included in the term "alkyl" is the alkyl portion of acyl groups.) Examples of this group of synthetic surfactants are the sodium and potassium alkyl sulfates, especially those obtained by sulfating the higher alcohols ($C_8$–$C_{18}$ carbon atoms) such as those produced by reducing the glycerides of tallow or coconut oil; and the sodium and potassium alkylbenzene sulfonates in which the alkyl group contains from about 9 to about 15 carbon atoms, in straight chain or branched chain configuration, e.g., those of the type described in U.S. Pat. Nos. 2,220,099 and 2,477,383. Especially valuable are linear straight chain alkylbenzene sulfonates in which the average number of carbon atoms in the alkyl group is from about 11 to 13, abbreviated as $C_{11-13}$LAS.

Other anionic surfactants herein are the sodium alkyl glyceryl ether sulfonates, especially those ethers of higher alcohols derived from tallow and coconut oil; sodium coconut oil fatty acid monoglyceride sulfonates and sulfates; sodium or potassium salts of alkyl phenol ethylene oxide ether sulfates containing from about 1 to about 10 units of ethylene oxide per molecule and wherein the alkyl groups contain from about 8 to about 12 carbon atoms; and sodium or potassium salts of alkyl ethylene oxide ether sulfates containing about 1 to about 10 units of ethylene oxide per molecule and wherein the alkyl group contains from about 10 to about 20 carbon atoms.

Other useful anionic surfactants herein include the water-soluble salts of esters of alpha-sulfonated fatty acids containing from about 6 to 20 carbon atoms in the fatty acid group and from about 1 to 10 carbon atoms in the ester group; water-soluble salts of 2-acyloxyalkane-1-sulfonic acids containing from about 2 to 9 carbon atoms in the acyl group and from about 9 to about 23 carbon atoms in the alkane moiety; water-soluble salts of olefin and paraffin sulfonates containing from about 12 to 20 carbon atoms; and beta-alkyloxy alkane sulfonates containing from about 1 to 3 carbon atoms in the alkyl group and from about 8 to 20 carbon atoms in the alkane moiety.

Water-soluble nonionic surfactants are also useful in the compositions of the invention. Such nonionic materials include compounds produced by the condensation of alkylene oxide groups (hydrophilic in nature) with an organic hydrophobic compound, which may be aliphatic or alkyl aromatic in nature. The length of the polyoxyalkylene group which is condensed with any particular hydrophobic group can be readily adjusted to yield a water-soluble compound having the desired degree of balance between hydrophilic and hydrophobic elements.

Suitable nonionic surfactants include the polyethylene oxide condensates of alkyl phenols, e.g., the condensation products of alkyl phenols having an alkyl group containing from about 6 to 15 carbon atoms, in either a straight chain or branched configuration, with from 3 to 12 moles of ethylene oxide per mole of alkyl phenol.

Preferred nonionics are the water-soluble and water-dispersible condensation products of aliphatic alcohols containing from 8 to 22 carbon atoms, in either straight chain or branched configuration, with from 3 to 12 moles of ethylene oxide per mole of alcohol. Particularly preferred are the condensation products of alcohols having an alkyl group containing from about 9 to 15 carbon atoms with from about 4 to 8 moles of ethylene oxide per mole of alcohol.

Semi-polar nonionic surfactants include water-soluble amine oxides containing one alkyl moiety of from about 10 to 18 carbon atoms and two moieties selected from the group of alkyl and hydroxyalkyl moieties of from about 1 to about 3 carbon atoms; water-soluble phosphine oxides containing one alkyl moiety of about 10 to 18 carbon atoms and two moieties selected from the group consisting of alkyl groups and hydroxyalkyl groups containing from about 1 to 3 carbon atoms; and water-soluble sulfoxides containing one alkyl moiety of from about 10 to 18 carbon atoms and a moiety selected from the group consisting of alkyl and hydroxyalkyl moieties of from about 1 to 3 carbon atoms.

Ampholytic surfactants include derivatives of aliphatic or aliphatic derivatives of heterocyclic secondary and tertiary amines in which the aliphatic moiety can be straight chain or branched and wherein one of the aliphatic substituents contains from about 8 to 18 carbon atoms and at least one aliphatic substituent contains an anionic water-solubilizing group.

Zwitterionic surfactants include derivatives of aliphatic, quaternary, ammonium, phosphonium, and sulfonium compounds in which one of the aliphatic substituents contains from about 8 to 18 carbon atoms.

Crystalline, Peroxyacid-Compatible Material

The purpose of the crystalline, peroxyacid-compatible material is to dilute the non-hydrated water level in the low speed mixer to a desired level for good particle formation, and to act as filler to achieve a desirable peroxyacid concentration in the product. This material can be divided into hydratable and non-hydratable materials. It is preferably not film-forming material. Suitable non-hydratable materials include silicate and/or crystalline surfactants (for example, surfactants having very high Krafft points); and/or nonionic salts. Suitable hydratable materials preferably have a pH between about 5.0–8.0, most preferably between about 6.0–7.0. These are preferably selected from the group consisting of sodium sulfate, sodium acetate, sodium perborate, sodium phosphate, sodium acid phosphite, lithium formate, lithium sulfate, zinc nitrate, and combinations thereof.

Preferred is sodium sulfate (most preferred). Materials to be avoided are halides and compounds containing heavy metals such as iron.

The approximate hydration temperatures of some of these materials are given below:

| | | |
|---|---|---|
| Sodium acetate | 136° F. | (580° C.) |
| Sodium phosphate | 94 | (35° C.) |
| Sodium perborate | 104 | (40° C.) |
| Sodium acid phosphite | 108 | (420° C.) |
| Sodium sulfate | 90 | (32° C.) |

These hydratable materials are useful in processing the bleach-containing particles of this invention and they add integrity to the final granule. The bleach-particles herein preferably comprise from about 10 to 95 weight % hydratable, peroxyacid compatible material.

The bleach particles made by the present invention can be used by themselves as a laundry bleach additive, but are preferably included in a conventional granular laundry detergent composition.

Preferred particulate bleaching compositions made according to this process comprise:

(1) from about 20 to about 90 wt % of substantially water-insoluble organic peroxyacid;

(2) from about 1 to about 40 wt % of peroxyacid-stable, water-soluble detergent surfactant selected from the group consisting of anionics, nonionics, zwitterionics, ampholytics, and mixtures thereof; and (3) from about 10% to about 80 wt % of crystalline, peroxyacid-compatible material.

Most preferably, they comprise:

(1) from about 35 to about 70 wt % of substantially water-insoluble organic peroxyacid;

(2) from about 2 to about 25 wt % of peroxyacid-stable, water-soluble detergent surfactant selected from the group consisting of anionics, nonionics, zwitterionics, ampholytics, and mixtures thereof; and (3) from about 20% to about 60 wt % of crystalline, peroxyacid-compatible material.

Preferred are particulate laundry detergent compositions which preferably comprise from about 0.5 to about 30 wt %, more preferably from about 1 to about 10 wt %, of the particles produced by the present process.

Preferred Process

Recovery of the NAPAA: During the chemical synthesis of NAPAA (wet end), NAPAA crystals are formed (precipitated) in a quench bath of optimum pH, temperature and concentration followed by a buffer washing operation. The buffer washing is done in a suspension containing –90% water. The solids, or crystals, are separated from the bulk solution before being fed to the "dry end", or particle forming operation. The NAPAA crystals are typically separated from the solution utilizing a vacuum filter belt to form a "vacuum filter cake". This vacuum filter cake typically consists of approximately 66.33% water, 1.75% peroxyacid available oxygen (AvO) (corresponding to 31.42% amide peroxyacid, and the rest (2.25%) unreacted starting material). This material is the crude reaction product of NAAA (mononononyl amide of adipic acid), sulfuric acid, and hydrogen peroxide which is subsequently quenched by addition to ice-water followed by vacuum filtration. Washing is continued until the pH of the filtrate is neutral. This vacuum filter cake is then subjected to phosphate buffer treatment by mixing with 0.10 M (moles/liter) solutions of NaH2P04, Na2HP04, and Na3P04 to achieve the desired pH (preferably between about 4.2 and about 4.8 (10% solution in $H_2O$)).

1. Optional Early Step - Pressure Filtration

The buffer washed slurry containing the recovered NAPAA described above is preferably formed into a "wet cake" of low moisture content. This liquid-solid separation is preferably achieved using a combined "vacuum/pressure/air blow" filtration unit. This process step reduces moisture from –90% down to typically 30% (can achieve 20% water remaining). The product is called wet cake since it is in a hard but breakable form but still contains moisture. This material is preferably ~60% active NAPAA but is typically unstable for use at normal temperatures due to the presence of moisture.

If the water content of the wet cake is lower, less free water will have to be diluted by recycle in step #3 below, thus reducing the required recycle ratio. If the moisture level is higher, more free water will have to be diluted or hydrated in step #3 below resulting in all of, one of, or combinations of higher recycle rates, requirement of cooler raw material feeds, requirement of lower mixer energy input levels in order to maintain a constant extrusion rate through step #4 below.

2. Step (a) Intimate Mixing

This wet cake is combined with a surface active agent, to aid in its solubility, through the use of a high shear mixing device. Without this step dissolution rates of the peroxyacid particles have been found to be hindered, thus hurting overall performance in a washing environment. The preferred ratio of peroxyacid to surfactant is 10:1. The preferred surfactant is LAS comprising about 50% LAS, and 50% water. The preferred high shear mixing device is a Teledyne-Readco Processor (extruder/mixer).

The Teledyne-Readco Continuous Mixer is a high shear blending device (an extruder/mixer) with low residence time capabilities (less than about 30 seconds) but is capable of handling high viscosity, low moisture solids. It is preferably employed in the NAPAA process to break down the NAPAA wet cake into small agglomerates, which has been found herein to maximize solubility, especially in hard water. Secondly, and importantly, NAPAA is intimately mixed in the extruder/mixer with a surfactant (preferably LAS). This step coats much of the NAPAA crystal surface area to aid in the ultimate dispersibility and solubility of the very hydrophobic NAPAA. The output of this high shear mixer is a highly viscous paste (similar to Crisco or PlaydoughΘ). The free moisture content in the paste is approximately 30%. (All of the water is "Free", non-hydrated).

The Readco mixer is an axial, twin barrel processing device having various adjustable internal paddles. For use herein, these paddles may be configured in a number of ways to accomplish appropriate intimate mixing. Most useful combinations are double flat paddles in series interspersed with helical paddles to force the peroxyacid/surfactant paste mixture through the unit.

Sodium linear alkylbenzene sulfonate (LAS) and delumped NAPAA wet cake are pumped and metered into the extruder/mixer, simultaneously, or alternatively, the LAS may be added sequentially about half way down its barrel. The LAS is ~45% active and is fed at ambient temperatures (~68° F., 20° C.). The pre-delumped wet cake is fed at ambient temperatures as well. The output of the Readco is an ~32% moisture paste which is ~58% active. The ratio of NAPAA to LAS is typically 10:1 on an active basis. While the extruder/mixer increases the temperature of the mixture (via energy input), the resulting temperature of product only increases ~2° F. above the product feed temperature due to cooling water in the barrel jacket of the extruder/mixer. The energy input by the mixer itself is approximately 2.0 KJ/kg.

Adding energy at any point in the process ultimately will lower the amount of hydration that can occur in step #3 thus increasing the free water; thus driving the demand for higher recycle ratios. Thus care must be taken to avoid unneeded/excessive levels of energy input prior to the actual particle formation. Care must be taken not to elevate the peroxyacid temperature above 100° F. (37.8° C.). This step produces a paste.

3. Step (b) Mixing

The preferred method is to use a Lodige KM continuous mixer, which is preferably used to prepare a mixture of the product of step (a), sodium sulfate and process recycle for extrusion. The purpose of the mixer is three-fold: (1) provide an opportunity to reduce the moisture of the step (a) paste to a level which is acceptable for extrusion, (2) homogenize the paste and the two streams of dry components so that a homogeneous particle can be formed and (3) offer sufficient residence time for a portion of the free moisture in the mixture to become hydrated by the sodium sulfate. All three streams entering the mixer are at approximately ambient temperature. The sodium sulfate and recycle are <0.5% moisture. Residence time in the mixer is critical in achieving the desired level of sulfate hydration while ensuring the mixer does not overmix and form agglomerates. A homogeneous "damp powder" is preferred. The contents in the mixer should never reach or exceed 90° F., which is the hydration temperature for sodium sulfate. Rather, the temperature is allowed to raise from ambient (68° F.) to near 90° F. by energy input from the mixer and from the heat of hydrating sulfate. To accomplish all these aspects of this mixing stage, both low speed plows and high speed choppers are preferably employed and fill level should be properly controlled.

The "damp" powder discharge must have a free moisture level between 7.5–11% (most desired 7.5–8.2%) for proper extrusion characteristics (preferred particle forming process—see step (c) below). The lowering of the feed 30% free moisture to the discharge –8.0% free moisture has been found to be driven by two phenomena:

(a) Dilution of the mixture with "dryer" recycle or fresh "filler" material.

(b) Partial hydration of the free water. If an exothermically hydratable salt is used as the filler, one can capitalize on the additional advantage of using partial hydration of this salt in combination with dilution. Care and energy balance understanding must be used when utilizing the advantages of partial hydration. If the mixture temperature reaches the hydration equilibrium temperature (like a melting point for ice) the hydration reaction ceases to absorb any more water and every stroke of the mixer is believed to release free moisture as it adds energy. The result can end up being a sticky mass which cannot be successfully granulated in an extruder. If the raw materials are too cold, or if the mixing energy input is too low, the mixer energy/thermal load may allow the hydration reaction to continue further than desired to the point that the mixture will contain too much hydrated salt, too little free moisture and result in a dry non-mixture below the level of free moisture required by the extrusion granulator. By using this method one can form particles with the mixture's free moisture in the desired range for the particular equipment piece but with total water levels much higher than the free moisture level, allowing for less recycle and its negative implications in the process.

This damp powder is then used as a feed to a particle forming step.

The concentration of the mixture in this stage, on a dry basis, is 35% active NAPAA, 3.5% LAS and ~59% sodium sulfate. In terms of feed rate to the mixer, the three components enter at approximately equal rates with the recycle being variable to ensure the proper mix moisture is being met.

4. Step (c) - Particle Forming

The resulting powder from step (b) can have between 3 and 15% free moisture depending on the type of particle formation equipment used. Turbulizers or any high energy input agglomeration machinery typically use lower moistures for particle formation (6–7%). Extruders use somewhat higher levels of 8–10% free moisture and are the preferred equipment pieces for this invention. Low energy agglomeration through continued mixing in the Lodige KM mixer or other low speed mixer can also be utilized to make an agglomerate, typically requiring somewhat higher free moisture levels, in the 11–15% free moisture range.

A Fuji-Paudal Twin Dome continuous extruder is in line after the Lodige KM. This device accepts the somewhat hydrated powder from the Lodige and forms it into cylinders of approximately 1 mm in diameter (hole diameter of die plate). The purpose of the extruder is to form the NAPAA mixture into defined particles which can be handled, dried, shipped and finally blended into a detergent. Finished particles should exhibit acceptable physical characteristics such as attrition resistance, low surface area per unit volume for stability optimization, acceptable rate of solubility, aesthetically appealing color and acceptable flow characteristics. The combined total moisture of the feed powder is ~11%, with ~20% of the total moisture being hydrated. The product leaves the extruder at the same total moisture and at basically the same temperature as the feed powder, or perhaps 1°–2° F. higher. Under proper extrusion, strands leave the extruder head looking spaghetti-like with lengths reaching 1.5 feet. The pH of the extrudates should again be between 4.2 and 4.8 on a 1% solution basis.

5. Optional Later Step - Drying

Preferably a fluid bed dryer is used. It has the advantage of controllable residence time and gentle "tossing" action which breaks the "rods" into the desired lengths of 1–7 mm. Care must be taken to keep the drying temperatures low to limit the thermal stress to which the peroxyacid is exposed.

The output of the extruder falls unhindered into the first zone of a fluid bed dryer. The purpose of the fluid bed dryer is to gently dry the extrudates to <0.5% moisture. The inlet temperature of the dryer is limited to 120° F. (49° C.) to minimize the thermal impact on the peracid during this operation. The dryer is operated with a cooling zone before its exit to provide temperature reduction before being handled and shipped. The product in the dryer never reaches 120° F. (49° C.) and is cooled to <85° F. before exiting the dryer. A secondary benefit of the fluid bed dryer is that bed agitation can be controlled to break the long strands which come from the extruder into near acceptable lengths by the time they exit the dryer.

6. Optional Step - Sizing

The output of the fluid bed dryer is preferably run through a sizing operation to remove the fines and overs. The fines are returned directly to the process as recycle as are the fines which are collected during fluid bed drying.

7. Optional Step - Size Reduction

A Comil basket type grinder is preferably used to size reduce agglomerated overs from the sizing operation. The output is blended with the fines noted above and are returned as process recycle. They will enter the process again at the Lodige mixer.

8. Optional Step - Coating Operation

The "Save" component of the sizing operation can undergo a coating operation targeted at improving the extrudates' flowability. This is necessary to ensure NAPAA extrudates can be bulk stored, shipped and unloaded with ease. The coating can come in either of two forms: (1) a dry coating such as a silica powder that can be applied in a typical mix drum or (2) a liquid coating such as a concentrated solution at ~120° F. (49° C.) of sodium sulfate which is applied by spraying onto the extrudates' surface. The water added at this step must be dried completely before the final extrudate can be shipped.

The following examples illustrate the compositions of the present invention. All parts, percentages and ratios used herein are by weight unless otherwise specified.

EXAMPLE I

Preparation of the NAPAA-wet cake:

A wet slurry of NAPAA (nonylamide of peroxyadipic acid) is prepared by combining 87 lbs NAPAA filter cake at 60% moisture, 168 lb deionized water, 10.95 lbs monosodium diprotic phosphate buffer ($NaH_2PO_4$), 1.09 lbs of metal sequestering agent (Dequest 2010), 1.1 lb 2,6-pyridinedicarboxylic acid 99% (DPA) and 370 ml 50% sodium hydroxide. The mixture is well mixed; final pH is 4.55 and temperature approximately 58° F. (15° C.).

The wet slurry is substantially dewatered and converted to "NAPAA-wet cake" via multiple single pass batch filtration using a laboratory scale 0.8 $ft.^2$ pressure filter (manufactured by Larox, Inc., Columbia, Md.). Typical operating conditions are as follows: 1 minute pumping at 80 psi; 6 minutes pressing at 220 psi; 5 minutes drying with 90 psi air. Typical results are: wet cake weight, 3.8 lbs; wet cake moisture, 26.7%, wet cake thickness, 1.0 inch; dry solids in cake, 2.7 lbs. The NAPAA-wet cake is then gently ground with a hammermill with coarse mesh screen so that all particles are less than ⅜" in size.

Preparation of the NAPAA/LAS Paste:

An intimate mixture of a soluble surfactant (LAS) and the insoluble NAPAA-wet cake is made by simultaneously combining the ground NAPAA-wet cake with a 50% solution of $C_{12-13}$ LAS in Teledyne-Readco 2" twin-barrel axial extruder/mixer. The NAPAA-wet cake is accurately metered to the throat of the Teledyne-Readco using a solids hopper-feeder device with a helical feed screw. The feed rate of this device is adjusted to deliver 250 g/min of the NAPAA-wet cake, having a moisture content of 27.18%. In a similar manner, the 50% solids LAS solution is accurately metered to the throat of the Teledyne-Readco using a positive displacement pump, delivering 35.4 g/min of the LAS solution. Thus, the finished NAPAA/LAS paste contains about 10% LAS solids on an active NAPAA basis.

The barrels of the Teledyne-Readco extruder/mixer are maintained at 68° F. (20° C.) by the use of cooling water flowing through the outside chamber of the extruder/mixer. The discharge of the device consists of a flat stainless steel plate which has multiple ½" holes drilled therein. The paste discharged from the Teledyne-Readco resembles large "spaghetti noodles". The feed streams were maintained to the Teledyne-Readco for a period of 63 minutes and about 30 lbs of NAPAA/LAS paste in noodle form were prepared.

Preparation of the finished 50% active NAPAA particles:

The NAPAA/LAS paste is then combined with a dry premix containing the proper amount of sodium sulfate and finished, dried 50% active NAPAA particles (recycle) to give about 11% to about 16% total water content and 50% active NAPAA in a V-blender with intensifier bar attachment. The V-blender rotated (at about 60 rpm) for 10 sec. and then rotated with operation of the intensifier bar (about 1700 rpm) for 30 sec.. Multiple small batches of these blends having a total weight of 69.5 lbs are then agglomerated in a pilot plant model Lodige KM mixer (having both plows and chopper attachment until proper agglomeration and particle size is obtained—about 10 to 15 minutes. The agglomerated mixture is then gently dried in multiple small batches in a fluid bed dryer at a temperature not exceeding 50° C. To complete the preparation the dried particles are ground and sized to exclude oversize and fine particles.

It has been found that the finished dried and sized 50% active NAPAA granular product thus prepared has a high rate of solubility even in cold water, is non-friable, has good stability and performs well as a bleaching agent in detergent formulations.

EXAMPLE II

Preparation of NAPAA Wet Cake (~30% moisture):

A wet slurry of NAPAA (nonylamide of peroxyadipic acid) is prepared by combining 200 kg of NAPAA stock (containing 61% water) and 403 kg of buffer solution containing 53 kg $NaH_2PO_4$ and 10 kg of Dequest 2010 in a 200 liter vessel with MIG impellers.

This slurry is then dewatered utilizing a LAROX filter apparatus which operates using vacuum/pressure/forced air as the means of separating the solid fraction from the slurry. The LAROX unit has a 0.1 $m^2$ filtration area and utilizes a polyester filter cloth. Typical operating conditions are: pump/vacuum for 2.0 minutes at 3.5 bar; pressure for 5 minutes at 12 bar and air blow for 5 minutes at 6 bar. Typical results are: wet cake weight=1.6 kg; wet cake moisture=29% and wet cake thickness=20 mm.

Filter cakes are subsequently ground using a Frewitt granulator such that all particles are <4 mm diameter in size.

Preparation of NAPAA/LAS Paste

An intimate mixture of a water soluble surfactant (LAS) and the insoluble NAPAA wet cake is made by simultaneously combining the ground NAPAA cake with a 50% active $C_{12-13}$ LAS source in a Teledyne-Readco 2" twin barrel axial extruder/mixer. The wet cake is introduced at the mixer throat while the LAS is pumped into an injection port on the mixer barrel. The extruder/mixer is run at 120 kg/hr with a rotational speed of 400 rpm. The output contains ~30% water and 56% NAPAA. The plate opening at the discharge of the mixer is about 2 $cm^2$ and was egg shaped.

Preparation of Premix

A 15 kg premix of NAPAA/LAS paste, sodium sulfate, and recycle (dry finished product returns) is prepared in a Loedige VT50 mixer. The mixer is operated for ~2 minutes and utilizes the plows full time and the chopper part time. Paste, sodium sulfate and recycle are added in levels such that a 11% total moisture, homogeneous powder results. Within the 2 minute mix time, the powder heats from ~25° C. to ~30° C. by means of energy input from the plows/choppers and due to approximately 20% of the total moisture undergoing hydration with sodium sulfate. On a dry basis the powder comprises ~35% NAPAA, ~60% sodium sulfate, ~3.5% LAS with the balance being other organics and minors.

Particle Formation

The premix is immediately fed to a Fuji Pandal EXD-100 radial extruder. The extruder is equipped with a 1 mm hole plate and is operated at a rate of ~600 kg/hr (wet basis). The extruder outputs cylindrical strands as long as 0.3 meters in length and 1 mm in diameter. The composition of the newly formed extrudate is identical to the premix described above.

Extrudate Drying

Extrudate drying is accomplished by spreading the wet strands from the extruder onto sheet pans with are subsequently placed in a vacuum oven. This drying operation reduces moisture of the extrudate from 11% to <0.5%. Once dried, the product is sized and is then ready for physical property evaluation. Drying is accomplished without raising the extrudate temperature above 50° C. The final particle contains 35% NAPAA, 3.5% LAS, ~60% sodium sulfate with the balance being other organics and minors.

EXAMPLE III

Preparation of NAPAA Wet Cake (~30% moisture):

A wet slurry of NAPAA (nonylamide of peroxyadipic acid) is prepared by combining 200 kg of NAPAA stock (containing 61% water) and 403 kg of buffer solution containing 53 kg $NaH_2PO_4$ and 10 kg of Dequest 2010 in a 200 liter vessel with MIG impellers.

This slurry is then dewatered utilizing a LAROX filter apparatus which operates using vacuum/pressure/forced air as the means of separating the solid fraction from the slurry. The LAROX unit has a 2.5 $m^2$ filtration area and utilizes a polyester filter cloth. Typical operating conditions were: pump/vacuum for 2.0 minutes at 3.5 bar; pressure for 5 minutes at 12 bar and air blow for 5 minutes at 6 bar. Typical results were: wet cake weight=6.8 kg; wet cake moisture= 29% and wet cake thickness= 20 mm.

Filter cakes are subsequently ground using a Frewitt granulator such that all particles are <4 mm diameter in size.

Preparation of NAPAA/LAS Paste

An intimate mixture of a water soluble surfactant (LAS) and the insoluble NAPAA wet cake is made by simultaneously combining the ground NAPAA cake with a 50% active $C_{12-13}$ LAS source in a Teledyne-Readco 2" twin barrel axial extruder/mixer. Cool (~40° F., 4° C.) water circulates around the mixer barrel to remove some of the mixer energy input and subsequent temperature increase. The wet cake (at 70° F., 21° C.) is introduced at the mixer throat while the LAS (at 110° F., 48° C.) is pumped into an injection port ~½ of the way down the mixer barrel. The extruder/mixer is run at 1500 kg/hr with a rotational speed of 308 rpm and a power consumption of 7.2KW (~2.0 Kj/kg feed once noload power draws are substracted). The output contains ~32% water and 56% NAPAA and was at approximately 70° F. (21° C.). The plate opening at the discharge of the mixer was a rectangular shape of approximately 2 cm by 12 cm.

Preparation of Premix

A 15 kg premix of NAPAA/LAS paste, sodium sulfate, and recycle (dry finished product returns) is prepared in a Loedige KM600 mixer. The mixer is operated for ~1.5 minutes and utilizes the plows full time and the chopper part time (about 20 seconds total). The mixer operates with plows at 70 RPM and choppers at 3400 rpm at ~35% of its fill capacity and inputs ~3.2 KJ/kg mixture fed. Paste, sodium sulfate and recycle are added in levels such that a 11% total moisture, homogeneous powder results. Within the mix time, the powder heats from ~21° C. to ~30° C. by means of energy input from the plows/choppers and due to approximately 15% of the total moisture undergoing hydration with sodium sulfate (thus leaving approximately 8.6% unbound, free moisture present in the mix). On a dry basis the powder comprises ~35% NAPAA, ~60% sodium sulfate, ~3.5% LAS with the balance being other organics and minors.

Particle Formation

The premix (at 30° C.) is immediately fed to a Fuji TDG-100 axial extruder. The extruder is equipped with a 1 mm hole plate and is operated at a rate of ~2000 kg/hr (wet basis) at 118 rpm consuming approximately 5 KW (about 2 Kj/kg fed after the subtraction of noload factors). The extruder outputs cylindrical strands as long as 0.5 meters in length and 1 mm in diameter. The composition of the newly formed extrudate is identical to the premix described above.

Extrudate Drying

Extrudate drying is accomplished in a 2 zoned, 10 $ft.^2$ fluidized bed. Air velocities of about 1.5 m/sec. are used to fluidize a bed of extrudates approximately 15" high. This drying operation reduces moisture of the extrudate from 11% to <0.5%. Once dried, the product is sized and is then ready for physical property evaluation. Drying is accomplished without raising the extrudate temperature above 50° C. (NAPAA is of course thermally sensitive). The final particle contains 35% NAPAA, 3.5% LAS, ~60% sodium sulfate with the balance being other organics and minors.

EXAMPLE IV

Granular laundry detergent compositions comprising the peroxyacid-containing particles of Example III are as follows.

| | I % | II % | III % |
|---|---|---|---|
| Sodium $C_{12-13}$ linear alkylbenzene sulfonate | 7.5 | 7.5 | 7.5 |
| Sodium $C_{14-15}$ alkyl sulfate | 7.5 | 7.5 | 7.5 |
| Sodium tripolyphosphate solids | 0 | 0 | 20.0 |
| Sodium aluminosilicate | 20 | 20 | 0 |
| Sodium silicate | 2 | 2 | 2 |
| Sodium carbonate | 20 | 20 | 20 |
| Sodium perborate monohydrate | 5 | 0 | 3 |
| Cg alkanoyloxybenzene sulfonate activator | 7 | 0 | 6 |
| Peroxyacid - containing particles from Example III | 2.7 | 7 | 2.7 |
| Savinase (Novo) enzyme | 0.3 | 0.3 | 0.3 |
| Brighteners/chelants/antifoaming agents/ perfumes/dyes | 9 | 9 | 9 |
| Sodium sulfate | 11 | 18.7 | 14 |
| Miscellaneous | | Balance | |

What is claimed is:

1. A process for preparing particulate bodies containing a substantially water-insoluble organic peroxyacid, said process comprising the steps of:

a) combining a substantially water-insoluble organic peroxyacid, wherein the peroxyacid is in the form of a wet cake comprising particles with an average particle diameter of from about 0,1 to about 260 micron, and a water-soluble detergent surfactant, in a ratio of peroxyacid to surfactant of from about 80:1 to about 5:1, and mixing to intimately contact the peroxyacid and the surfactant to form a paste;

b) adding to the paste from step (a) a hydratable material and dried particulate bodies recycled from step (c) and mixing, at a temperature that does not exceed the temperature of hydration of the hydratable material, to form a powder discharge comprising from about 3% to about 15% free moisture;

c)forming particulate bodies by extruding the powder discharge of step (b) under conditions such that the total moisture of the particulate bodies is the same as the powder discharge entering Step (c);

d) drying the particulate bodies at a temperature less than 120° F., and e) separating a portion of the dried particulate bodies form step (d) for recycle into step (b).

2. A process according to claim 1 wherein the hydratable material added in Step (b) is selected from the group consisting of silicates, sodium sulfate, sodium acetate, sodium perborate, sodium phosphate, sodium acid phosphite, lithium formate, lithium sulfate, zinc nitrate, and combinations thereof.

3. A process according to claim 2 wherein the hydrated moisture of the hydratable material comprises at least 20% of the total moisture of the powder discharge of Step (b).

4. A process according to claim 1 wherein Step (b) is carried out at a temperature which is between freezing and the temperature of hydration of the hydratable material.

5. A continuous process according to claim 4 wherein less than 40% of the dried particulate bodies produced in Step (d) are separated for recycle into Step (b).

6. A continuous process according to claim 5 wherein the surfactant combined with the peroxyacid wet cake in Step (a) is an anionic surfactant.

7. A continuous process according to claim 6 wherein in Step (a) the peroxyacid wet cake comprises 6-(nonylamino)-6-oxocaproic acid and the surfactant comprises sodium linear alkylbenzene sulfonate.

8. A process according to claim 1 wherein the peroxyacid is selected from the group consisting of 4-nonylamino-4-oxoperoxybutyric acid, 6-(nonylamino)-6-oxocaproic acid, 1,12-diperoxydodecandioic acid, heptylsulfonylperpropionic acid, decysulfonylperpropionic acid, heptylsulphonylperbutyric acid, octylsulphonylperbutyric acid, nonylsulphonylperbutyric acid, decylsulphonylperbutyric acid, and mixtures thereof.

9. A process according to claim 8 wherein the peroxyacid wet cake in Step (a) comprises from about 20% to about 80% by weight peroxyacid.

10. A process according to claim 9 wherein Step (a) is carried out in a high shear mixer, an extruder or an extruder/mixer.

11. A process according to claim 9 wherein Step (b) is carried out in a low speed mixer, and Step (c) is carried out in an extruder.

12. A process according to claim 9 wherein Step (b) is carried out in a high speed mixer, and Step (c) is carried out in a low speed mixer/agglomerator.

13. A process according to claim 9 wherein in Step (a) the peroxyacid wet cake comprises 6-nonylamino)-6-oxocaproic acid and the surfactant comprises sodium linear alkylbenzene sulfonate.

14. A process according to claim 9 wherein the drying Step (d) is carried out until the particulate bodies comprise less than about 0.5 wt % of water.

15. A process according to claim 14 wherein the peroxyacid wet cake in Step (a) comprises particles with an average particle diameter of from about 10 to about 100 microns.

* * * * *